US005094671A

United States Patent [19]

Hall et al.

[11] Patent Number: 5,094,671

[45] Date of Patent: Mar. 10, 1992

[54] GRINDING TOOLS

[75] Inventors: Richard Hall; Paul Dando, both of Gloucester; John Robertson, Lambourn; Kassim Juma, Stafford, all of United Kingdom

[73] Assignee: Unicorn Industries PLC, Birmingham, England

[21] Appl. No.: 537,124

[22] Filed: Jun. 13, 1990

[30] Foreign Application Priority Data

Jul. 6, 1989 [GB] United Kingdom ..... 8915449

[51] Int. Cl.[5] ..... B24D 18/00

[52] U.S. Cl. ..... 51/293; 51/295; 51/298; 51/307; 51/308

[58] Field of Search ..... 51/293, 295, 298, 307, 51/308

[56] References Cited

U.S. PATENT DOCUMENTS

| | | | |
|---|---|---|---|
| 1,338,598 | 4/1920 | Thomas . | |
| 2,544,060 | 3/1951 | Amberg et al. | 106/44 |
| 2,837,416 | 6/1958 | Ervin, Jr. | 51/308 |
| 3,249,410 | 5/1966 | Lorenzo et al. | 51/293 |
| 3,416,905 | 12/1968 | Waugh | 51/296 |
| 3,528,790 | 9/1970 | Shrewsbury et al. | 51/293 |
| 3,634,453 | 1/1972 | McManus et al. | 260/325 |
| 3,794,474 | 2/1974 | Megens | 51/295 |
| 3,864,101 | 2/1975 | Charvat | 51/298 |
| 3,950,149 | 4/1976 | Fukuda | 51/298 |
| 4,334,895 | 6/1982 | Keat | 51/309 |
| 4,385,907 | 5/1983 | Tomita et al. | 51/296 |
| 4,634,453 | 1/1987 | Hay et al. | 51/293 |

FOREIGN PATENT DOCUMENTS

| | | |
|---|---|---|
| 321209 | 6/1989 | European Pat. Off. . |
| 487287 | 6/1938 | United Kingdom . |
| 1163811 | 9/1969 | United Kingdom . |
| 1273253 | 5/1972 | United Kingdom . |
| 1269589 | 11/1972 | United Kingdom . |
| 1398030 | 6/1975 | United Kingdom . |

*Primary Examiner*—William R. Dixon, Jr.
*Assistant Examiner*—Willie J. Thompson
*Attorney, Agent, or Firm*—Nixon & Vanderhye

[57] ABSTRACT

The invention relates to grinding tools, particularly to grinding wheels having an annular band of abrasive material at their periphery and provides an improved method of manufacture. A mixture of abrasive material, temporary binder and ceramic bond is heated to paste-like consistency and then coated on to the desired part of a support member, e.g. on to hub (5) of wheel (4) in the form of an annular band (11). The coated support member is then fired to drive off the temporary binder whereby the coating is firmly bonded to the support member.

10 Claims, 2 Drawing Sheets

GRINDING TOOLS

This invention relates to grinding tools, particularly to vitrified bonded grinding tools and to a method of making such tools.

Grinding tools, e.g. wheels, are well known for the working of, for example, metals and ceramics. Such wheels typically comprise a band of suitable grinding material, e.g. of cubic boron nitride or of diamond, aluminium oxide, silicon carbide or mixtures thereof, bonded to the periphery of a supporting disc, which may be of any suitable material, e.g. metal, ceramic or plastics material.

Various methods for the manufacture of the grinding wheels are known. The abrasive medium is usually mixed in a suitable bonding material and cold pressed, hot-pressed or pressure-sintered around the rim of the supporting disc in a suitable mould to form the annular abrasive band around the rim.

U.S. Pat. No. 3,794,474 describes an alternative technique in which a ceramic profiled supporting grinding wheel is used to grind a counter profile in a steel mould, the diameter of the supporting wheel is reduced so that a gap is formed between it and the profiled steel mould, a mixture of cold-setting synthetic binder and diamond grains is coated on the circumference of the supporting disc which is then rotated in the mould to shape the grinding band around said periphery.

A yet further technique is described in U.S. Pat. No. 4,634,453, in which a slip of abrasive and vitreous bond is coated onto the peripheral surface of a porous ceramic hub, while applying vacuum through the hub, conforming the surface of the coating to the desired shape and firing it to produce the desired grinding annulus on the hub.

The present invention aims to provide an improved method of forming the desired abrasive grinding portion on a supporting hub or disc.

Accordingly, in a first aspect, the invention provides a method of making a grinding tool in which a mixture is formed of abrasive material, temporary binder and ceramic bond, the mixture is heated to paste-like consistency and is then applied to form a coating on a portion of the exterior of a supporting member and the article is fired to drive off the temporary binder and to fuse the ceramic bond, whereby the coating is firmly bonded to the supporting member.

In another aspect the invention provides a grinding tool made by the aforesaid method.

The invention will be more specifically described with reference to abrasive grinding wheels in which the supporting member is a disc or wheel and the abrasive mixture is formed as a band around the circumference of the disc, the band being generally annular in shape.

It will be appreciated that any desired profile may be applied to the band before it is fired into its final form. In particular, the profile of the circumference of the supporting disc onto which the abrasive mixture is formed may be flat and the abrasive mixture may be shaped into any desired profile by means of a suitable forming tool. Alternatively, the profile of the circumference of the supporting disc may have any suitable non-re-entrant shape as may the profiled abrasive band. Thus the band may have a flat profile on a flat supporting profile, a curved, non-re-entrant profile on a flat supporting profile or either a flat or curved, non-re-entrant profile on a curved non-re-entrant profile.

The temporary binder may be, for example, polyethylene glycol, stearic acid, polyvinyl alcohol or polyacrylic acid.

The temporary binder has the properties such that when the mixture is heated prior to its application to the supporting member, it melts or softens sufficiently to make the consistency of the mixture paste-like for ease of application. After application of the paste-like mixture, the temporary binder solidifies again as the mixture cools and it then acts as green binder for the formed but unfired product. On firing, the temporary binder is driven off and the coherence of the product is then maintained by the fusion of the ceramic bond constituent.

The abrasive material is preferably diamond grains or cubic boron nitride grains. They may, for example, have sizes in the range 1 mm to 1 micron or even less.

Optionally a filler material, e.g. aluminium oxide or silicon carbide, may be included with the abrasive material.

The Ceramic binding material may be, for example, a powdered glass frit and/or a powdered mixture of suitable glass-forming materials, e.g. clay, feldspar and borax.

The proportions of the constituents are preferably as follows, the amounts being by volume:

| | |
|---|---|
| abrasive | 5 to 75% |
| filler | 0 to 75% |
| ceramic bond | 5 to 50% |
| temporary binder | 5 to 50% |

As indicated above, the raw materials to form the abrasive mixture are blendable to form a homogeneous mixture of paste-like consistency and it is preferred that the mixture of abrasive material, temporary binder and Ceramic binding material be applied to the supporting disc by an extrusion technique.

The band of abrasive mixture is preferably profiled by feeding the heated mixture into the nip between the supporting disc and a profiling wheel, the latter having the counter profile of the desired product.

Embodiments of the invention will now be described by way of illustration only by reference to the accompanying drawings in which.

Figure 1:
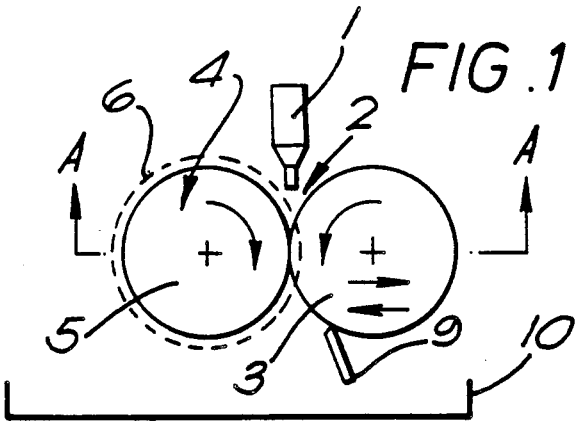
FIG. 1 is a diagrammatic illustration of an apparatus for applying a heated extruded abrasive mixture to the circumference of a supporting wheel.
Figure 2:
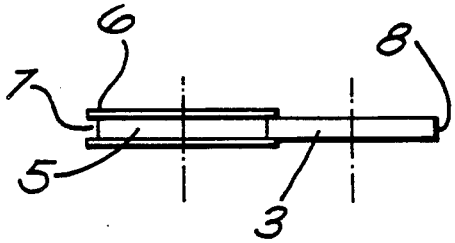
FIG. 2 is a section on line A—A of FIG. 1.

Referring to FIGS. 1 and 2, an abrasive mixture containing abrasive material, temporary binder and Ceramic binding material fed to a heated extruder 1 mounted to feed into the nip 2 between interneshed profiling wheel 3 and supporting wheel 4, the latter being to receive an annular band of the abrasive mixture.

Supporting wheel 4 comprises a central hub 5 that will form the supporting centre of the eventual product and two side constraint plates 6 coaxially mounted one on each side of hub 5 but being of larger diameter to define an annular gap 7 around the circumference of hub 5 in which the annular abrasive band will be formed. Profiling wheel 3 has a shape at its circumference 8 that is the counter profile corresponding to the desired profile of the annular abrasive band.

The abrasive mixture fed into nip 2 is constrained to form an annular band around hub 5 by clockwise rotation of wheel 4 and anti-clockwise rotation of wheel 3 during the extrusion. The size of the nip may be increased during the process to increase the thickness of the applied band. This may be achieved by any suitable mechanism to increase the distance between wheels 3 and 5, either of which may be moveable towards and away from the other.

Wheel 3 is formed of an anti-stick material or with an anti-stick coating to discourage pick-up of the abrasive mixture. For example it may be of P.T.F.E., polymethyl methacrylate, aluminium or steel. Additionally, a scraper 9 in contact with wheel 3 removes any such mixture that does attach to the wheel and deposits it in recovery tray 10.

If desired wheel 5 and the band of mixture forming on it may be warmed or cooled as appropriate, e.g. by means of a hot/cold air blower (not shown). Wheel 3 may similarly be warmed or cooled, if desired.

Figure 3:
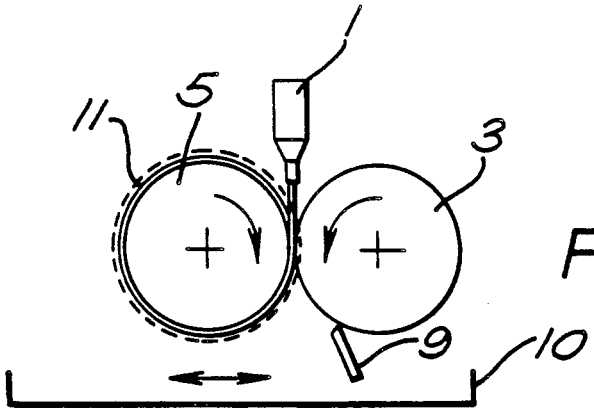
FIG. 3 is a similar view to that of FIG. 1 after the extrusion has been applied.

FIG. 3 shows an annular band 11 of the abrasive mixture forming within gap 7 of wheel 4.

Figure 4:
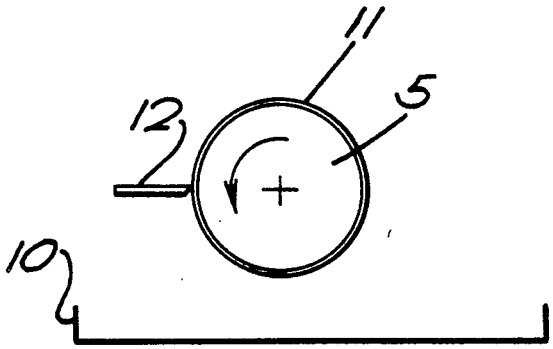
FIG. 4 is a diagrammatic illustration of the supporting wheel with its applied circumferential band prior to the firing.

FIG. 4 shows hub 5 with the side restraints removed and having annular band 11 around its circumference. While still in the unfired 'green' state, further profiling of the circumference may take place, e.g. by rotation in contact with tool 12.

The shaped product is then placed in a furnace and fired to a temperature between 500° C. and 1400° C. to remove the organic binder constituent and fuse the ceramic bond to form the desired product in which the abrasive annular band 11 is firmly bonded to the supporting central hub.

A controlled firing regime is used to allow the binder to be driven off at a relatively low temperature before final firing at a higher temperature within the range. The actual conditions required will, of course, vary from mixture to mixture but will be readily determinable by the average skilled man of the art.

Figure 5:
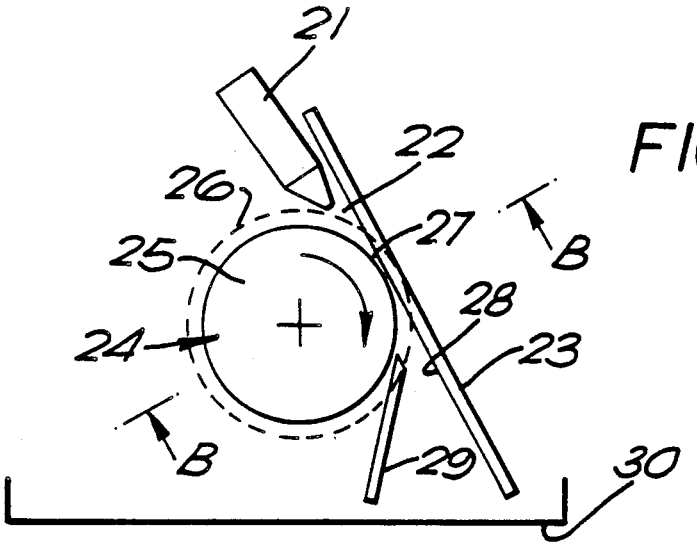
FIG. 5 is a diagrammatic illustration of an alternative apparatus for applying a heated extruded abrasive mixture to the circumference of a supporting wheel.
Figure 6:
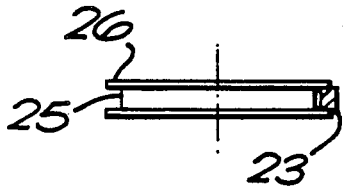
FIG. 6 is a section on line B—B of FIG. 5.

Referring to FIGS. 5 and 6, a similar abrasive mixture is fed to heated extruder 21 mounted to feed into the nip 22 between a forming bar 23 and supporting wheel 24, the latter, as in FIG. 1, being to receive an annular band of the abrasive mixture.

As in FIG. 1, support wheel 24 comprises a central hub 25 that will form the supporting centre of the eventual product and two side constraint plates 26 coaxially mounted one on each side of hub 25 but being of larger diameter to define an annular gap 27 around the circumference of hub 25 in which the annular abrasive band will be formed. Forming bar 23 has a profile at its face 28, which contacts the abrasive annular band, that is the counter profile of the desired profile of the band.

As in the previous embodiment, the abrasive mixture fed in to nip 22 is constrained to form an annular band around hub 25 by clockwise rotation of wheel 24 during the extrusion. As before, the size of the nip may be increased during the process to increase the thickness of the applied band.

As for wheel 3 of the previous embodiment, forming bar 23 may be of or coated with anti-stick material. Scraper 29 removes excess mixture and deposits it in recovery tray 30.

Hub 25 and the band of mixture forming on it may be warmed or cooled as appropriate by means of a hot/-cold air blower (again not shown). Forming bar 23 may similarly be warmed or cooled, if desired.

Figure 7:
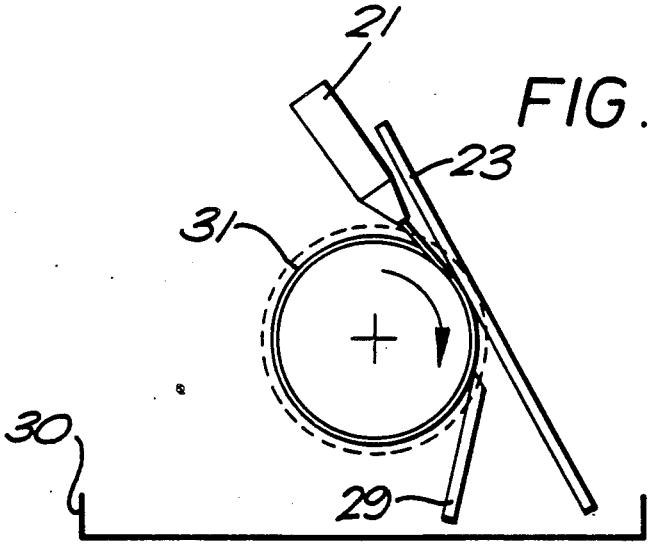
FIG. 7 is a similar view to that of FIG. 5 after the extrusion has been applied.

FIG. 7 shows an annular band 31 of the abrasive mixture forming within gap 27 of wheel 24.

After formation of band 31 is completed, the side restraints are removed as before and the shaped product fired as described above in a furnace to remove the temporary binder and fuse the ceramic bond.

Examples of suitable abrasive mixtures are given below.

| EXAMPLE 1 | Parts by volume |
|---|---|
| cubic boron nitride (FEPA size D91) | 47 |
| clay/feldspar/borax/powdered glass frit bond | 8 |
| stearic acid | 45 |

| EXAMPLE 2 | Parts by volume |
|---|---|
| abrasive (as Example 1) | 45 |
| ceramic bond (as Example 1) | 20 |
| stearic acid | 28 |
| polyethylene glycol | 7 |

We claim:

1. A method of making a grinding tool comprising the steps of:

(i) mixing an abrasive material Ceramic binder material and a temporary binder to form a mixture;

(ii) heating the mixture to a paste-like consistency;

(iii) applying a coating of the mixture on a portion of the exterior of a supporting member to provide a coated member; and (iv) firing the coated member to drive off the temporary binder so as to fuse the Ceramic binder material so that the coating is firmly bonded to the supporting member.

2. A method according to claim 1, in which the mixture is extruded onto the supporting member.

3. A method according to claim 1, in which the supporting member is a wheel and the mixture is applied to form an annular band around the circumference of the wheel.

4. A method according to claim 1 in which said temporary binder is selected from the group consisting of polyethylene glycol, stearic acid, polyvinyl alcohol and polyacrylic acid.

5. A method according to claim 1, in which said Ceramic binding material is selected from the group consisting of:

i) a powdered glass frit, ii) a powdered mixture of clay, feldspar and borax, iii) mixtures of i) and ii).

6. A method according to claim 1, in which said abrasive material is selected from the group consisting of diamond and cubic boron nitride.

7. A method according to claim 1, in which said coated member is fired in stages in a range from 500° C. to 1400° C.

8. A method of making a grinding tool according to claim 1 wherein said abrasive material includes a filler.

9. A method of making a grinding tool according to claim 8 wherein said filler is selected from the group consisting of aluminum oxide and silicon carbide.

10. A method of making a grinding tool comprising;

extruding an abrasive mixture into an annular gap in the surface of a rotating supporting wheel, so as to form an annular band;

affixing a profile to the surface of the annular band while on the supporting wheel; and hardening the annular band so that the supporting member and band become permanently united one to another.

* * * * *